US005147146A

United States Patent [19]

Harding, Jr.

[11] Patent Number: 5,147,146

[45] Date of Patent: Sep. 15, 1992

[54] VARIABLE PITCH POWER TROWEL

[75] Inventor: Edward M. Harding, Jr., Middletown, Md.

[73] Assignee: Equipment Development Company, Inc., Frederick, Md.

[21] Appl. No.: 673,720

[22] Filed: Mar. 22, 1991

[51] Int. Cl.[5] ..... E01C 19/22

[52] U.S. Cl. ..... 404/97; 404/112

[58] Field of Search ..... 404/97, 96, 112

[56] References Cited

U.S. PATENT DOCUMENTS

| | | | |
|---|---|---|---|
| 2,621,568 | 12/1952 | Fletcher . | |
| 2,887,934 | 5/1959 | Whiteman . | |
| 2,979,996 | 4/1961 | Spitler et al. . | |
| 2,983,203 | 5/1961 | Fletcher | 404/112 |
| 3,412,657 | 11/1968 | Colizza et al. . | |
| 4,320,986 | 3/1980 | Morrison . | |
| 4,673,311 | 6/1987 | Whiteman, Jr. . | |
| 5,096,330 | 3/1992 | Artzberger | 404/112 X |

*Primary Examiner*—Ramon S. Britts
*Assistant Examiner*—Nancy Connolly
*Attorney, Agent, or Firm*—Birch, Stewart, Kolasch & Birch

[57] ABSTRACT

A power trowel surface finishing machine comprising a rotatable trowel blade assembly having a plurality of trowel blades disposed on a circumferentially-spaced arrangement, each of the trowel blades being mounted for rotation on radial axes substantially parallel to the surface to be finished, said trowel blades being adapted to rest on the surface to be finished and rotate across the surface; a first adjustment mechanism including a rotary knob for selectively pivoting the trowel blades about the respective radial axes thereof to selectively adjust the pitch of the blades in controlled increments throughout an adjustment range with respect to the surface and maintain the pitch so selected within the adjustment range; and a second adjustment mechanism including a pivotable lever coupled to said first adjustment mechanism for overriding said first adjustment mechanism and rapidly pivoting the trowel blades about the respective radial axes to position the trowel blades from the selected pitch to another selected pitch within the adjustment range in response to manual movement of the second adjustment mechanism by an operator from a rest position, and for rapidly returning the blades to the selected pitch set by the first adjustment mechanism when returned by the operator to the rest position; whereby high or low spots of the surface to be finished can be rapidly removed or filled, respectively, by movement of the second adjustment mechanism.

3 Claims, 2 Drawing Sheets

VARIABLE PITCH POWER TROWEL

The present invention relates to a surface finishing apparatus such as a variable speed power trowel for applying epoxy mortar to a concrete surface or the like. More specifically, the present invention relates to improved means for adjusting the pitch of a rotatable trowel blade assembly whereby high or low spots of the surface to be finished can be rapidly removed or filled by an operator of the finishing apparatus by rapidly changing the pitch of the trowel blades of the assembly with respect to a pitch selected for the majority of the finishing operation.

Power trowel finishing machines are known including trowel blade assemblies having a plurality of trowel blades disposed in a circumferentially-spaced arrangement wherein each of the trowel blades are mounted for rotation on radial axes substantially parallel to the surface to be finished, and the respective trowel blades are adapted to rest on the surface to be finished, and rotate across the surface to spread epoxy mortar or concrete during operation of the machine. These machines include an elongated handle and a manually activated adjustment mechanism at the upper end of the handle which is adjustable by the operator to vary the pitch of the trowel blades about the radial axes thereof. This adjustment means may include a rotatable adjustment mechanism on the upper end of the handle coupled to the trowel blade assembly through a cable running longitudinally of the handle and over appropriate pulleys to an adjustment lever coupled to the trowel blade assembly. Rotation of this adjustment knob causes movement of the cable and thereby adjustment of the trowel blades. An alternative adjustment mechanism for such a device is a lever and ratchet arrangement which also may be coupled to a similar type of cable, pulley and lever arrangement for incrementally adjusting the pitch of the trowel blades to selected fixed operating positions within an adjustment range. Generally this adjustment range extends from a pitch of 0°, wherein the trowel blades are flat with respect to the surface to be finished, to a pitch of slightly less than 90° with respect to the surface to be finished.

During operation of a trowel blade finishing machine the operator selects an operating pitch within a range from 0 to approximately 30° at which the machine will best function for the type of mortar or material being spread on top of the surface to be finished. However, during the course of operation of the machine high or low spots of mortar or the like may be observed by the operator as the machine approaches them and in such case it is useful to rapidly change the pitch of the trowel blades to an angle that approaches 90° to remove the high or low spots. With adjustment mechanisms known heretofore, such as with a rotatable knob or the lever ratchet arrangement, it is difficult to rapidly change the pitch of the trowel blades to remove these high or low spots. In fact it is usually necessary to stop the machine and reset the pitch of the blades to a new position before proceeding to remove the high or low spots of mortar. This of course is time consuming and also may result in some discontinuities in the surface being finished due to interruption of the finishing process.

Accordingly, a need in the art exists for an adjustment means for a power trowel surface finishing machine which can rapidly remove or fill high or low spots on the mortar surface being finished without stopping the machine.

SUMMARY OF THE INVENTION

Accordingly, it is a primary object of the present invention to provide a power trowel surface finishing apparatus including an adjustment means for rapidly varying the pitch of the blades of the trowel blade assembly in order to remove or fill high or low spots in the surface being finished.

It is another object of the present invention to provide an adjustment means for rapidly varying the pitch of trowel blades of the trowel blade assembly with one hand of the operator while the other hand of the operator continues to guide and control the movement of the machine.

It is still another object of the present invention to provide an adjustment means for rapidly varying the pitch of trowel blades associated with the trowel blade assembly of a surface finishing machine which can be retrofit onto existing machines in order to provide this additional trowel blade adjustment function as a supplement to the standard pitch adjustment functions of the machine.

These and other objects of the present invention are fulfilled by providing a power trowel surface finishing machine comprising a rotatable trowel blade assembly having a plurality of trowel blades disposed in a circumferentially-spaced arrangement, each of the trowel blades being mounted for rotation on radial axes substantially parallel to the surface to be finished, said trowel blades being adapted to rest on the surface to be finished and rotate across the surface; first adjustment means for selectively pivoting the trowel blades about the respective radial axes thereof to selectively adjust the pitch of the blades in controlled increments throughout an adjustment range with respect to the surface and maintain the pitch so selected within the adjustment range; and second adjustment means coupled to said first adjustment means for overriding said first adjustment means and rapidly pivoting the trowel blades about the respective radial axes to position the trowel blades from the selected pitch to another selected pitch within the adjustment range in response to manual movement of the second adjustment means by an operator from a rest position, and for rapidly returning the blades to the selected pitch set by the first adjustment means when returned by the operator to the rest position; whereby high or low spots of the surface to be finished can be rapidly removed or filled, respectively, by movement of the second adjustment means.

The surface finishing machine includes an elongated handle having a first distal end adjacent the trowel blade assembly and a second distal end remote therefrom and the first adjustment means includes a rotatable knob mounted at the second distal end of the handle, a cable extending along the handle between the first and second distal ends, and linkage means coupling the cable to the rotatable trowel blade assembly, whereby rotation of the knob moves said cable and linkage means and selectively adjusts the pitch of the trowel blades.

The second adjustment means includes an adjustment lever mounted on the handle adjacent the second distal end thereof, said lever having a rest position and a range of movement with respect thereto and connecting means coupled to the cable of the first adjustment means for moving said cable in response to movement by an operator of the adjustment lever from the rest position to other positions within the range of movement thereof.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF PREFERRED EMBODIMENTS

Figures 1, 2:
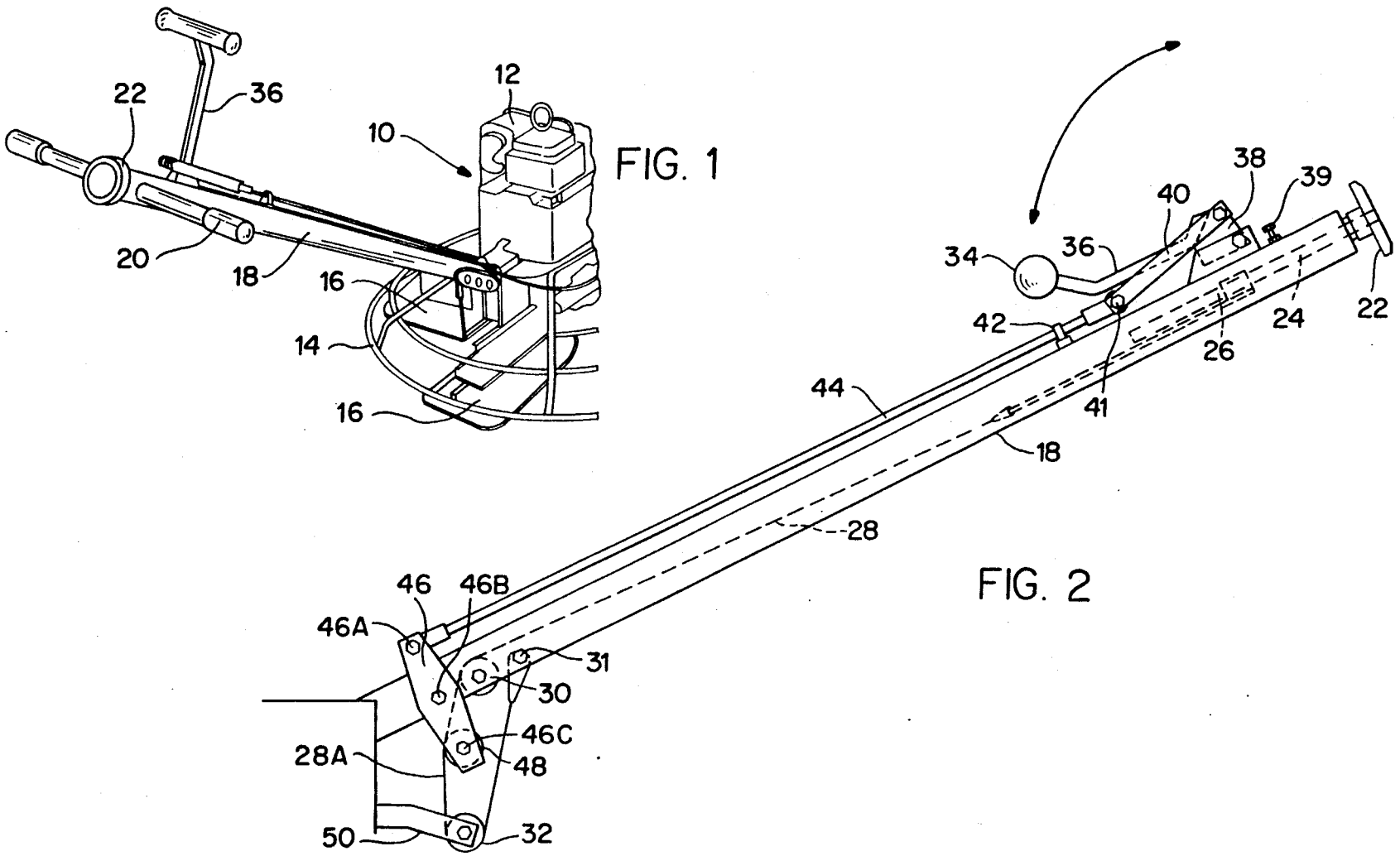
FIG. 1 is a perspective view illustrating the power trowel surface finishing machine of the present invention.
FIG. 2 is a partial elevational view of the trowel blade pitch adjustment means incorporated into the handle of the surface finishing machine of FIG. 1.

Referring to FIG. 1 there is generally illustrated a power trowel surface finishing machine 10 including a motor 12, a frame 14 and a plurality of substantially planar trowel blades 16 coupled to a central hub of a rotary shaft of the machine. The blades 16 are circumferentially-spaced and rest on the surface to be finished. A machine of this general type is disclosed in U.S. Pat. No. 2,887,934 to Whiteman issued May 26, 1959. Another example of such a machine is disclosed in U.S. Pat. 4,673,311 to Whiteman issued Jun. 16, 1987.

The surface finishing machine also includes an elongated handle 18 extending from the frame 14 at its lower end to an upper position at about waist level of an operator. The upper end of the handle 18 is provided with handle bard 20 which may be grasped by the operator for guiding the machine across the surface being finished.

The adjustment means for the pitch of the trowel blades in accordance with the present invention may be best illustrated by reference to FIG. 2. An adjustment knob 22 is provided at the upper end of the handle 18 and is coupled to a screw shaft 24 threaded within a fixed nut or follower 26 rigidly affixed within the handle 18. A cable 28 is attached to the lower end of the threaded shaft 24 and extends down through the handle 18 over pulleys 30 and 32 and an end is looped onto a pin 31 fixed to the handle 18 near the bottom thereof. Accordingly, rotation of knob 22 turns shaft 24 within nut 26 and either pulls or pushes cable 28 within handle 18 depending on the direction of rotation of knob 22. As cable 18 for example is pulled up within the handle 18 it pulls on pulley 32 and pivots lever 50.

Lever 50 is coupled to the rotatable trowel blade assembly and a pitch angle adjustment mechanism thereof of any suitable type such as the type disclosed in U.S. Pat. No. 2,887,934 to Whiteman. Therefore, knob 22 can be rotated to adjust the pitch of the trowel blades between a flat position with zero pitch to a substantially vertical position of about 90° with respect to the flat position of the blades. The adjustment knob 22 is utilized to select a fixed position of operation of the trowel blades for finishing and spreading the mortar being applied to the surface being finished. Adjustment of the pitch of the trowel blades with knob 22 is incremental and relatively slow in operation since knob 22 is generally set to a desired position prior to turning the finishing machine on.

A second adjustment mechanism includes a lever 36 having a ball 34 on one end thereof to be grasped by an operator. The lever 36 is pivotally mounted within a frame 40 which is pivotally mounted within an overcenter bracket mechanism 38. In FIG. 2 and FIG. 3A lever 36 is shown in a rest position in which it has no influence on the pitch of the respective blades of the trowel blade assembly (the blades are flat). However, when the lever 36 is pulled back by an operator over the range indicated by the arrow it pulls up on cable portion 28A which is engaged by a pulley 48 mounted about pivot axis 46C. Pulley 48 is mounted within a bracket 46 which is pivotally connected to handle 18 at 46B. An additional pivot point 46A has a rod 44 connected thereto which extends therefrom up to the top of the handle 18 through a guide 42 and is pivotally connected at 41 to bracket 40.

Figure 3C:
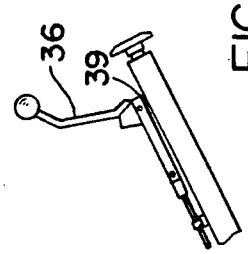
FIGS. 3A to 3C are diagrammatic illustrations of the adjustment handle of FIG. 2 in three successive positions.
Figure 3A:
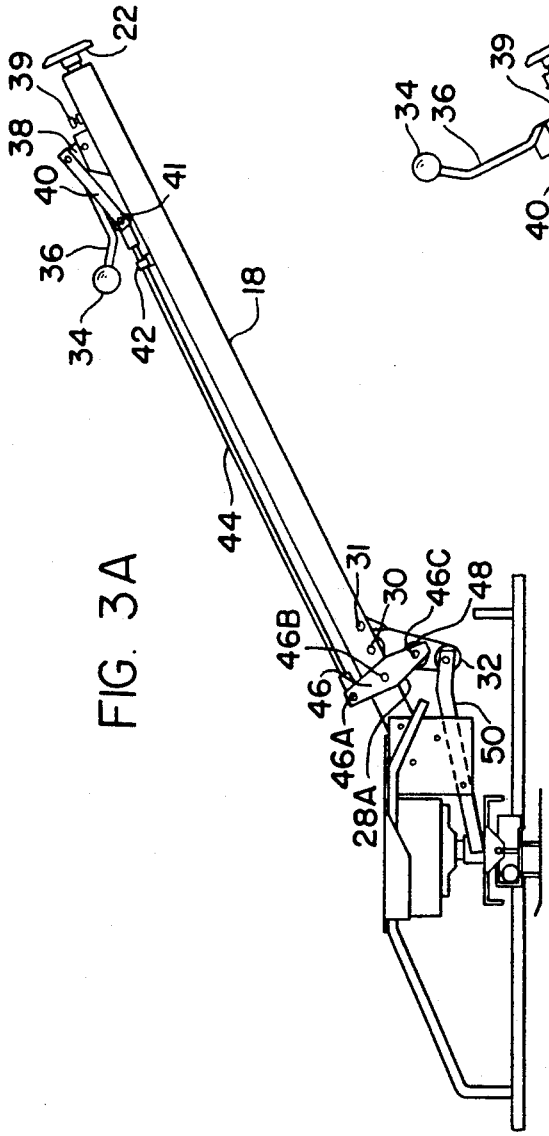
Figure 3B:
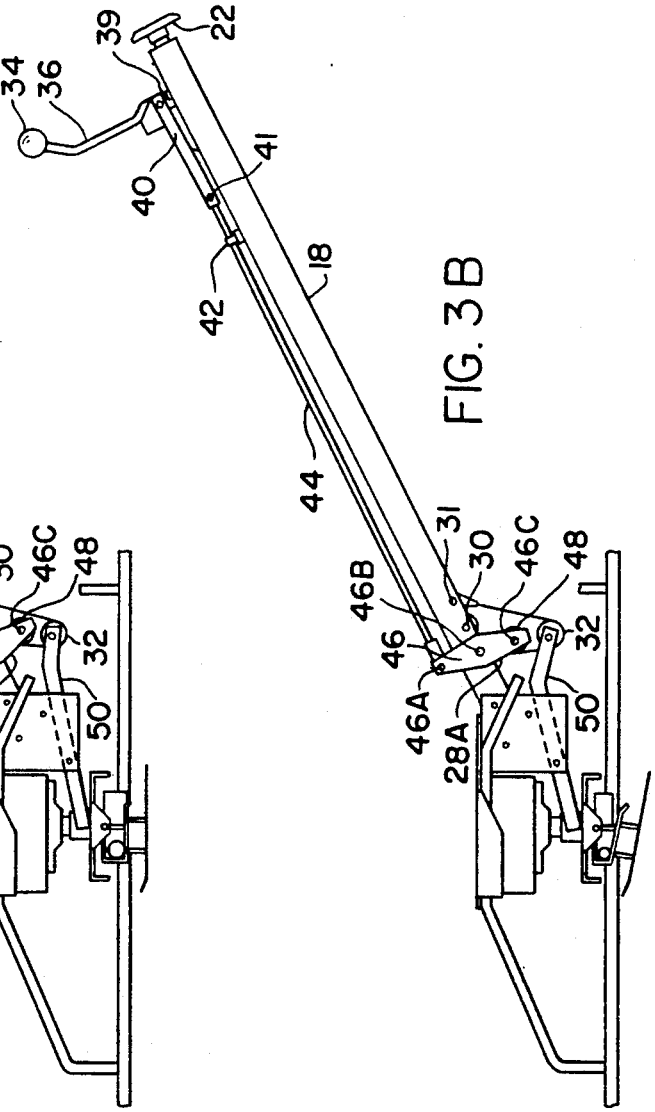

Referring in more detail to FIG. 2 and FIGS. 3A to 3C the adjustment mechanism is provided with an adjustable screw 39 just behind bracket 38. As illustrated in the respective positions of FIGS. 3A to 3C the position of adjustment screw 39 determines how far back bracket 38 can pivot responsive to the movement of lever 36. In FIG. 3A the blades 16 are untilted in a flat position and in FIG. 3B blade 16 is tilted to an operating or finishing position and lever 36 is disposed at substantially 90° with respect to the handle of the machine since bracket 38 engages adjustment screw 39 in the position shown. However, if adjustment screw 39 is turned so that it is essentially flush with the handle of the machine as illustrated in FIG. 3C bracket 38 and lever 36 can be pivoted over center or beyond a 90° orientation which due to the camming action of bracket 38 will essentially lock lever 36 in the position shown in FIG. 3C. In the position of FIG. 3B lever 36 will automatically return to the position of FIG. 3A when not held by an operator.

Accordingly it can be seen that when an operator rapidly pulls back on lever 36 rod 44 is pulled upwardly through guide 42 along the top of handle 18 pivoting bracket 46 about pivot axis 46B and raising pulley 48 to lift upwardly on portion 28A of cable 28. This in turn lifts pulley 32 upwardly and associated lever 50 to change the pitch of trowel blades 16 from whatever pitch they were set at by knob 22 to a maximum pitch position approaching 30° with respect to the surface to be finished. Therefore, the second adjustment means including lever 36 overrides the adjustment means including the rotatable knob 22 to provide for the rapid change of the pitch of the respective trowel blades. This is very useful during the operation of the trowel in order to rapidly change the pitch of the trowel blades and rapidly remove or fill high or low spots of mortar associated with a surface being finished without the need to shut down the machine and make a slower incremental adjustment using the rotatable adjustment knob 22.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A surface finishing apparatus comprising:

a rotatable trowel blade assembly having a plurality of trowel blades disposed in a circumferentially-spaced arrangement, each of the trowel blades being mounted for rotation on radial axes substantially parallel to the surface to be finished, said trowel blades being adapted to rest on the surface to be finished and rotate across the surface;

first adjustment means for selectively pivoting the trowel blades about the respective radial axes thereof to selectively adjust the pitch of the blades in controlled increments throughout an adjustment range with respect to said surface and maintain the pitch so selected within the adjustment range; and second adjustment means coupled to said first adjustment means for overriding said first adjustment means and rapidly pivoting the trowel blades about the respective radial axes to position the trowel blades from the selected pitch to another selected pitch within the adjustment range in response to manual movement of the second adjustment means by an operator from a rest position and for rapidly returning the blades to the selected pitch set by the first adjustment means when returned by the operator to the rest position;

whereby high or low spots of the surface to be finished can be rapidly removed or filled, respectively, by movement of the second adjustment means.

2. The apparatus of claim 1 further including an elongated handle having a first distal end adjacent said trowel blade assembly and a second distal end remote therefrom and wherein said first adjustment means comprises a rotatable knob mounted at the second distal end of the handle, a cable extending along the handle between the first and second distal ends, and linkage means coupling the cable to the rotatable trowel blade assembly, whereby rotation of the knob moves said cable and linkage means and selectively adjusts the pitch of the trowel blades.

3. The apparatus of claim 2 wherein said second adjustment means comprises an adjustment lever mounted on said handle adjacent the second distal end thereof, said lever having a rest position and a range of movement with respect thereto and connecting means coupled to the cable of the first adjustment means for moving said cable in response to movement by an operator of the adjustment lever from said rest position to other positions within the range of movement thereof.

* * * * *